US007210664B2

(12) United States Patent
McCracken

(10) Patent No.: US 7,210,664 B2
(45) Date of Patent: May 1, 2007

(54) CONCRETE FORM HAVING ADJUSTABLE CURVATURE

(75) Inventor: Robert McCracken, Urbandale, IA (US)

(73) Assignee: Wilian Holding Company, Des Moines, IA (US)

( * ) Notice: Subject to any disclaimer, the term of this patent is extended or adjusted under 35 U.S.C. 154(b) by 223 days.

(21) Appl. No.: 10/913,177

(22) Filed: Aug. 6, 2004

(65) Prior Publication Data

US 2006/0027729 A1 Feb. 9, 2006

(51) Int. Cl.
*E04G 9/10* (2006.01)
*E04G 11/08* (2006.01)

(52) U.S. Cl. ..... 249/194; 249/47

(58) Field of Classification Search ..... 249/189, 249/190, 191, 192, 193, 194, 195, 196, 33, 249/40, 44, 45, 46, 47, 219.1, 219.2
See application file for complete search history.

(56) References Cited

U.S. PATENT DOCUMENTS

| | | | | | |
|---|---|---|---|---|---|
| 2,793,720 | A | * | 5/1957 | Hawes | 249/210 |
| 4,185,805 | A | * | 1/1980 | Ewing | 249/194 |
| 4,553,729 | A | * | 11/1985 | Connors | 249/40 |
| 4,566,141 | A | * | 1/1986 | Mahoney | 4/506 |
| 4,679,763 | A | | 7/1987 | Brotherton | |
| 4,915,345 | A | | 4/1990 | Lehmann | |
| 5,137,251 | A | | 8/1992 | Jennings | |
| 5,590,493 | A | | 1/1997 | Wilson | |
| 5,857,300 | A | * | 1/1999 | Gates | 249/210 |
| 5,975,482 | A | * | 11/1999 | Wu et al. | 249/194 |
| 6,012,699 | A | * | 1/2000 | Wu et al. | 249/189 |

FOREIGN PATENT DOCUMENTS

| | | | | |
|---|---|---|---|---|
| EP | 0 233 643 | * | 8/1987 | 249/192 |
| EP | 0 321 006 | * | 6/1989 | 249/33 |
| JP | 6-212787 | * | 8/1994 | 249/189 |

* cited by examiner

*Primary Examiner*—Michael Safavi
(74) *Attorney, Agent, or Firm*—Kent A. Herink; Emily E. Harris; Daniel A. Rosenberg

(57) ABSTRACT

Supplemental bridging straps are used to increase the strength of a flexible metal concrete form assembly. A metal form has a flexible panel member with a perimetral flange projected laterally from one side thereof. Each of a pair of transversely opposite side sections of the flange is segmented by a plurality of longitudinally spaced V-shaped notches having their apices adjacent the one side of the panel member to provide for a lateral flexing movement of the panel member to a preselected shape. With the panel member in the predetermined shape, the segments in each of the flange side sections are connected together against relative movement to retain the predetermined shape of the panel member. In a first preferred embodiment, each flange segment is connected to an adjacent flange segment by a flexible metal strap. In a second preferred embodiment, extended flexible metal straps are used to interconnect a central flange segment to each of the pair of adjacent flange segments. The supplemental bridging straps bridge or span across adjacent flexible metal straps and the straps are interconnected to a corresponding flange segment.

3 Claims, 6 Drawing Sheets

CONCRETE FORM HAVING ADJUSTABLE CURVATURE

BACKGROUND OF THE INVENTION

The invention relates generally to concrete forms and, more specifically, to concrete forms that are flexible to an adjustable curvature for forming sections of concrete structures having curved surfaces.

Concrete construction forms are generally prefabricated by the manufacturer for use in a particular structural application such as corner forms, linear wall forms, or form parts for assembly on the job to build structures having a curved surface and the like. Thus, in U.S. Pat. No. 2,616,148, a form assembly enables the casting of generally curved surfaces to a particular desired curvature by the use of flexible metal sheets arranged with their side portions in an overlapping relation and having reinforcing members at such side portions that are adjustably clamped to a supporting scaffold to secure the flexible sheets in the desired curved pattern to form an arched roof. Arched roof constructions are also shown in U.S. Pat. Nos. 2,436,543 and 2,933,056. U.S. Pat. No. 3,971,176 discloses a permanently formed wooden stud-truss that has a curved central arch section positioned between a pair of straight end sections. The central arch has transverse slots or notches the sides of which are moved into contact engagement to provide the desired curvature. Before being closed the slots are filled with an adhesive compound to maintain the central arch in permanent deflection.

A concrete form including a flexible panel having an adjustable curvature is described in U.S. Pat. No. 4,679,763. The concrete form is flexible to conform to any desired curvilinear shape having no radius of curvature less than the design limitations of the form. A strap or tension member substantially coextensive with the length of the form and including a plurality of elongated openings is used in association with a plurality of nut and bolt combinations to hold the form in the desired curvilinear shape. Because the single strap extended the entire length of the form, the elongated openings became quite extended at the side edges of the form. Due to the length of the form and the relatively small radii of curvatures to which the flexible form could be made to conform, a single strap could not function for both positive and negative radii of curvatures. This prior art form, accordingly, required two straps, only one of which was used in any given structure of form work. A flexible concrete form that would reduce the number of loose parts and simplify use of the form is desired.

An improved concrete form having a flexible panel is described in U.S. Pat. No. 6,012,699. Instead of a single strap, this patent teaches the use of a plurality of strap segments having a first portion fixed to a perimetral flange of the form and an opposite, free end portion that was bolted to another portion of the flange in an adjusted position to hold the form in the desired shape.

Another concrete form having a flexible panel is described in U.S. Pat. No. 5,975,482. The single strap is replaced by a plurality of strap segments having a central portion that is bolted onto the perimetral flange and a pair of opposing, free end portions that are bolted to respective other portions of the flange in an adjusted position to hold the form in the desired shape.

While each of these flexible panel forms has wide commercial application, new advances in concrete construction have created a need for a flexible form that has a greater load strength. In particular, new concrete formulations allow for higher levels of plastic concrete to be poured into forms than before, placing a greater load on the forms that must be resisted in order to form the concrete into the desired shape. Moreover, new concrete formulations have altered physical properties that further increase the load applied to the forms. Even a modest increase in the strength of the flexible form will allow significantly higher heads of concrete to be poured and result a concomitant reduction in the time and labor required to form the concrete structure. Accordingly, there is a need for a flexible concrete form having an adjustable curvature that is capable of resisting higher plastic concrete loads.

SUMMARY OF THE INVENTION

The invention provides a concrete metal form that is transportable as a unit and may be adjusted for use in the construction of concrete structures having either planar or curvilinear surfaces, or a combination of such surfaces. The form is easily and quickly convertible on the job for such applications to appreciably reduce manufacturing, handling and storage costs by the elimination of a plurality of special job forms. The form has a flexible metal panel member with an integral perimetral flange and ribs projected laterally from one side. A pair of transversely opposite side sections of the perimetral flange are divided into a plurality of segments by longitudinally spaced V-shape notches the apices of which are adjacent the one side of the panel member, to provide for a lateral flexing movement of the panel member to a desired curved shape. This desired shape may obtained, for example, by placing the form on a fixture or jig with the opposite side of the panel member against a predetermined curved surface on the fixture.

In the prior art flexible form of U.S. Pat. No. 5,975,482 (which is incorporated herein by this reference), with the panel member flexed against the curved surface, the segments in each of the flange sections are rigidly but releasably connected together against relative movement by a plurality of retaining or tension strap segments that have a central portion fixed to a corresponding one of the plurality of the flange segments and a pair of opposite, free end portions that extend laterally to adjacent flange sections on either side of the central flange segment. Nut and bolt combinations are used to hold the free end portions of the strap segments to maintain the predetermined curved shape of the flexed panel member. The form is then removed from the fixture for use. As a result of the notch separation of the flange segments and the releasable connection of the segments to hold a predetermined curved shape of the panel member, the form may be readily converted from a curvilinear shape to a planar shape, and vice versa, or to a combination of such shapes as dictated by the job requirements.

The present invention consists of a plurality of supplemental bridging segments that span the gap between neighboring free end sections of the tension strap segments. The supplemental bridging segments dramatically increase the strength of the flexible form, allowing it to hold at least twice the head of plastic concrete compared to the unmodified flexible form.

DESCRIPTION OF A PREFERRED EMBODIMENT

Figure 1:
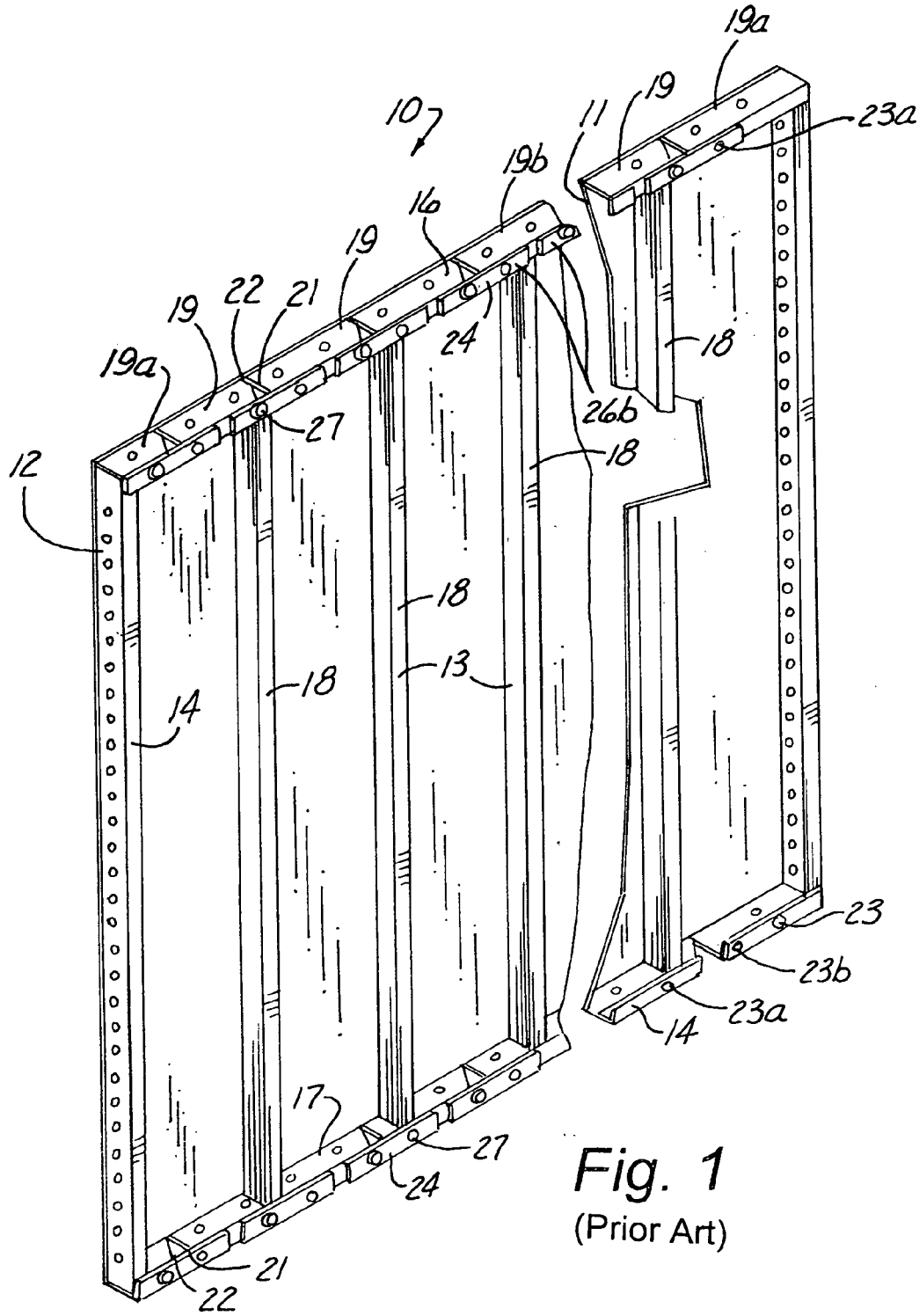
Fig. 1 (Prior Art)
FIG. 1 is a foreshortened rear perspective view of the metal concrete form of this invention, with parts removed for clarity, showing its use for forming a concrete structure having a planar surface.
Figure 2:
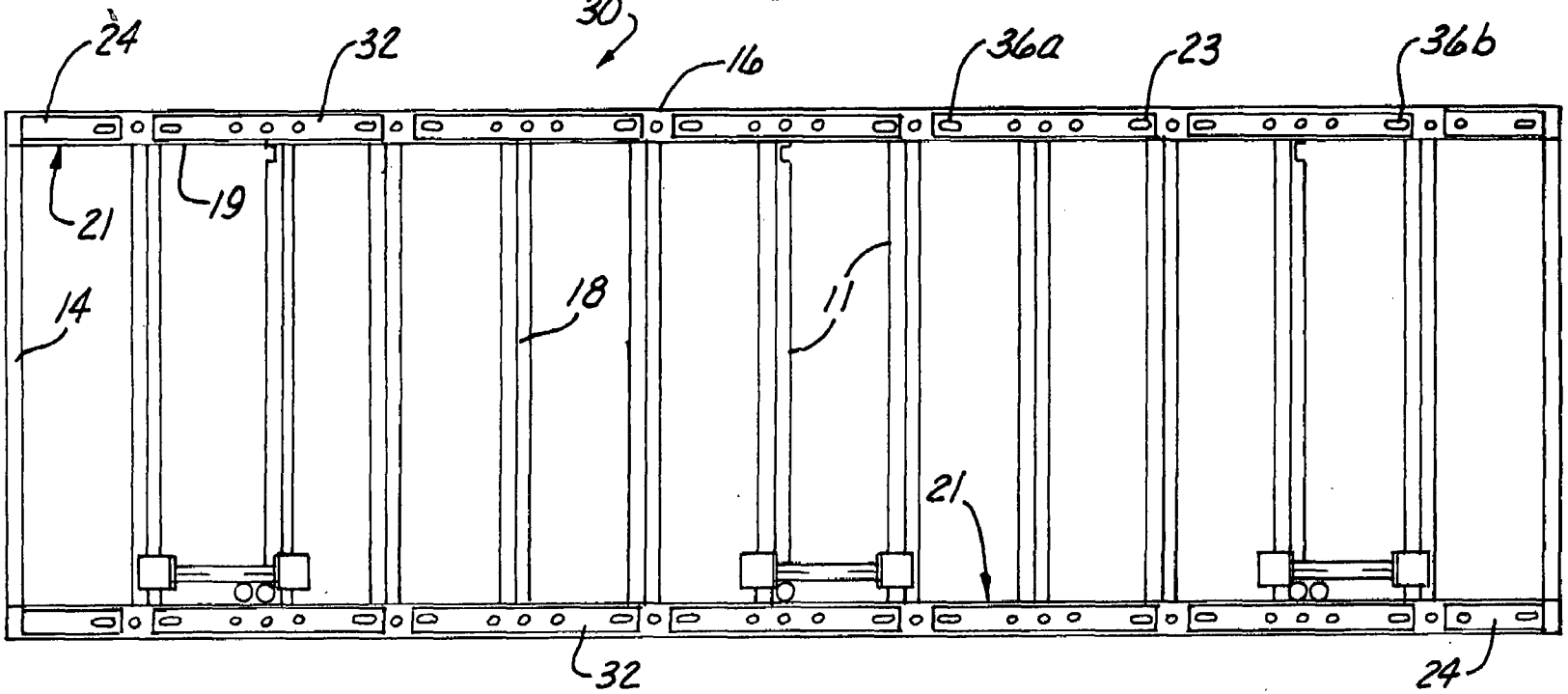
FIG. 2 is rear elevational view of the concrete form of FIG. 1 and showing tension strap segments attached to the form.

Referring to FIGS. 1 and 2 of the drawings, there is shown a metal concrete form 10 of a generally pan shape having a panel member 11 with a perimetral flange 12 projected laterally from one side 13 thereof. The flange 12 has a terminal flat surface portion or projection 14 in a parallel relation with the panel member 11. Spaced longitudinally of a pair of transversely opposite side sections 16 and 17 of the flange 12 and extended therebetween in a parallel spaced relation are a plurality of brace members 18 each of which is secured as by weldments to the one side 13 of the panel member 11. As shown in FIG. 1, each brace member is of a height substantially equal to the height of the flange 12 with its opposite ends underlying the terminal projections 14 on the flange side sections 16 and 17.

For the purpose of converting the form 10 to on-site use in the construction of concrete structures having either planar or curvilinear surfaces, each of the side flange sections 16 and 17 is divided into a plurality of segments 19 by V-shape notches 21 having their apices 22 adjacent the side 13 of the panel member 11 and each of which is located between adjacent brace members 18. A first of the end segments 19*a* is formed with a single, round hole 23*a*, a second, opposite of the end segments 19*a* is formed with a single, round hole 23*b*, and each remaining segment 19 with a pair of longitudinally spaced, round holes 23*a* and 23*b*.

Figure 4:
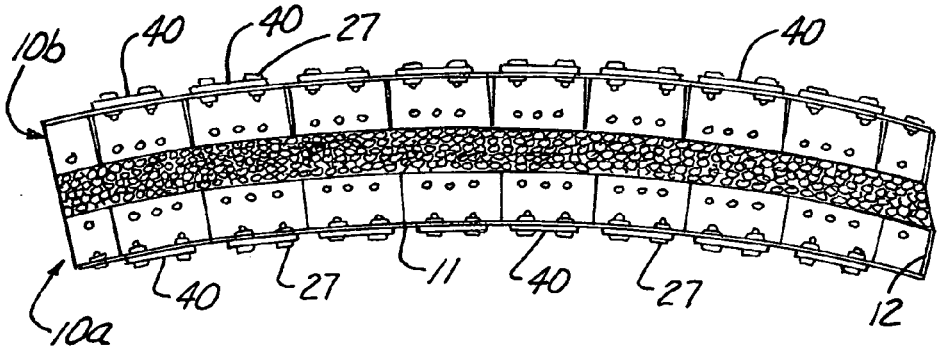
FIG. 4 is a top view illustrating the use of a pair of the metal concrete forms to build a wall structure having a curvilinear surface.
Figure 6:
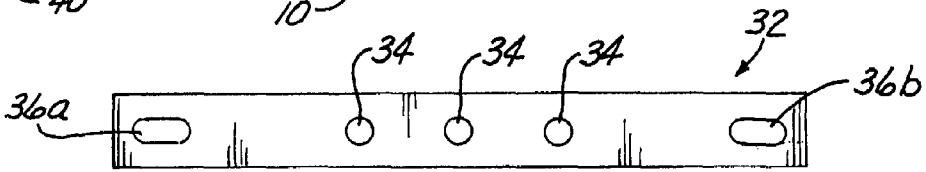
FIG. 6 is an elevational view of a tension strap segment.

The panel member 11 is formed from a sheet steel material so as to be bendable laterally of the form 10 at the notches 21 from the planar position illustrated in FIG. 1 to the reversely curved positions illustrated in FIG. 4. The planar shape of the panel member 11 in FIG. 1, in the construction of concrete structures having planar surfaces, is maintained by a plurality of tension strap segments, one of which is illustrated in FIG. 6 at 32 and foreshortened tension strap segments 24 (FIG. 2). The strap segments 32 have at least one opening 34 located centrally of the strap segments 32 and have a pair of elongated openings 36*a* and 36*b* at opposite end portions of the strap segment 32.

In use with the form 10, a central portion of the strap segments 32 is fixed to an inner one of the flange segments 19. During assembly a nut and bolt combination is used to hold the strap segment 32 in place through aligned openings 23 and 34. The strap segment 32 is then fixed by weldments or the like to the respective flange section 19, whereupon the bolt assembly may be removed. Upon being fixed on the flange segment 19, the opposing, free end portions of the strap segment 32 extend over the two next adjacent flange segments 19 with the elongated openings 36*a* and 36*b* over corresponding ones of the openings 23. Bolt assemblies 27 insertable through the aligned openings on being tightened lock the segments 19 in each flange section against relative movement whereby to maintain the planar adjustment of the panel member 11.

When the form 10 is to be used to build a concrete structure having a curvilinear surface, each of the tension strap segments 32 is released from its flange segment locking position by loosening of the bolt assemblies 27 to provide for its repositioning with respect to the flange sections 16 and 17. To curve the panel member 11 generally convexly, as illustrated for the form 10*a* in FIG. 4, the form, with the tension strap segments 32 released, is flexed to the desired shape, for example by placing it against a form or fixture, normally of a wooden construction, and having a predetermined generally concave surface. In one embodiment of the invention, the sheet metal forming the panel member 11 and the perimetral flange 12 have a thickness of about 3/16 inch. The brace members 18 are also formed from a 3/16 inch sheet metal material so that the form 10 has an average weight of about twenty pounds per square foot. All components are formed of hot-rolled mild steel. This weight is generally sufficient to conform the panel member 11 to a supporting curved surface without the application of any additional weight or pressure.

With the form 10 thus positioned on the fixture, the bolt assemblies 27 at the elongated holes 26*b* in the strap segments 24 are tightened. Following this initial adjustment of the bolt assemblies, all of the bolt assemblies are then torqued uniformly to about two hundred foot pounds. By virtue of the elongated shape of the openings 36*a* and 36*b* in the tension strap segments 32, movement of the tension member relative to the bolt assemblies fixed in the holes 23 in the flange section 16 and 17, is permitted to accommodate the curvilinear shape of the panel member 11.

In the adjustment of the form 10 to its curved shape shown in FIG. 4 at 10*b*, the procedure is similar to that followed in the curvilinear shaping of the form 10*a*. In this respect the fixture has a predetermined curved surface of a generally convex shape. With the tension members 32 relaxed, relative to the flange side sections 16 and 17, the form 10 is placed against the fixture. Similarly to the procedure described above, the center bolt assemblies 27 are initially tightened, after which the bolt assemblies to each side thereof are alternately tightened and then finally uniformly torqued to about two hundred foot pounds.

It is seen, therefore, that in adjusting the form 10 for planar surface structures, the bolt assemblies 27 are positioned substantially centrally of the elongated openings 36*a* and 36*b* in the tension member 32 (FIG. 2) and that when the panel member 11 is adjusted to curvilinear reverse positions thereof, the bolt assemblies 27 are at one or the other of the ends of the longitudinal openings (FIG. 4). The radius of a curvilinear surface will be limited by the contact engagement of opposite side portions of the notches 21 which are of a size to permit generation of predetermined curved surfaces about radii of twenty feet and greater. It is apparent that to convert the form 10 from a curvilinear shape to a planar shape the tension members 32 are relaxed and the panel member positioned against an available flat surface, after which the tension member is rigidly secured to the flange side sections 16 and 17.

Figure 3:
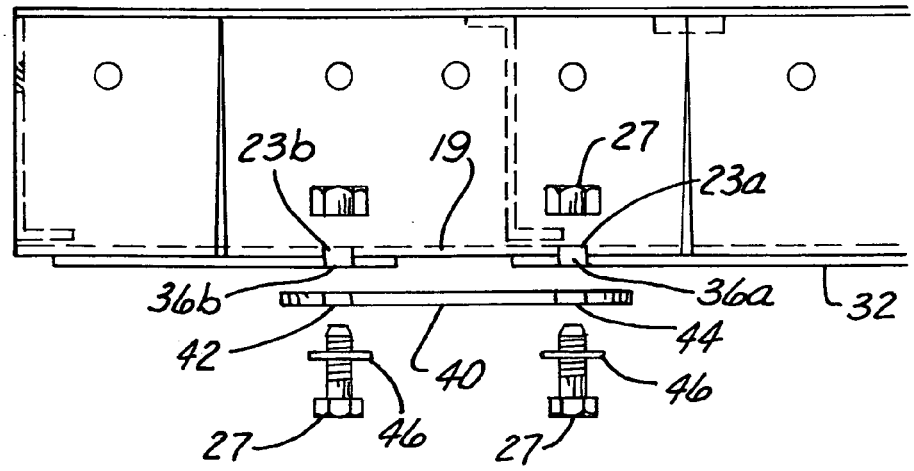
FIG. 3 is an enlarged top view of a portion of the form showing in exploded view a supplemental strap segment and the nut and bolt combinations used to attach it to the form.
Figure 5:
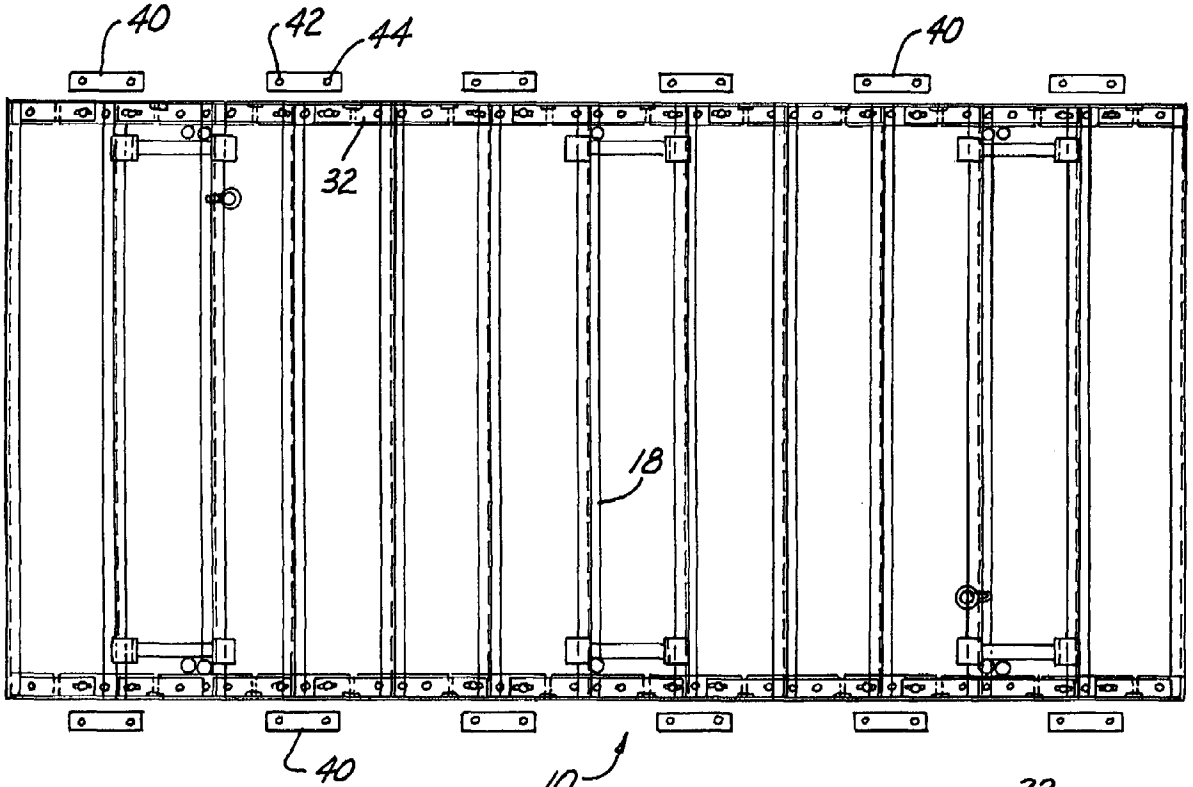
FIG. 5 is a rear elevational view of the concrete form of FIG. 1 with a plurality of supplemental strap segments shown adjacent the position they will have when assembled as part of the form.

In accordance with the present invention, a plurality of supplemental bridging straps 40 (FIG. 5) are added to the form 10. The bridging straps 40 are preferably of approximately the same width, thickness and material as the tension straps 32; in a preferred embodiment, the straps are made of one-quarter inch thick mild steel. Each bridging strap 40 has a pair of bolt openings 42 and 44 in their opposite end portions. In assembling a form 10 using the bridging straps 40, the bridging straps 40 are positioned, as shown in FIGS. 3 and 5, with the openings 42 and 44 aligned with opening 36*b* of a first tension strap 32 and opening 36*a* or a next adjacent tension strap 32, respectively. Nut and bolt assemblies 27, preferably including a washer 46, are then inserted through the aligned openings 42, 36*b* and 23*b* of a first flange segment 19 and the aligned openings 44, 36*a* and 23*a* of the same flange segment 19, and loosely tightened. The form 10 is then moved to its adjusted position as described previously and the nut and bolt assemblies 27 are tightened to about 200 foot-pounds to hold the form 10 in its adjusted shape. The bridging straps 40 serve as short struts to resist tensile and compressive forces between flange segments 19. The nut and bolt combinations 27 are pretensioned to create friction between the strap 40 and the segment 19 to resist the tensile and compressive forces. The form 10 will fail to hold its shape under concrete pressure when the forces in the strap 40 exceed the friction created by pretensioning the nut and bolt combinations 27. The bridging straps 40 create a second load path at the connection between the strap and the flange segment. The same bolt pretensions the joint between the flange segment 19 and the tension strap 32 as well as the joint between the tension strap 32 and the supplemental bridging strap 40.

Figure 7:
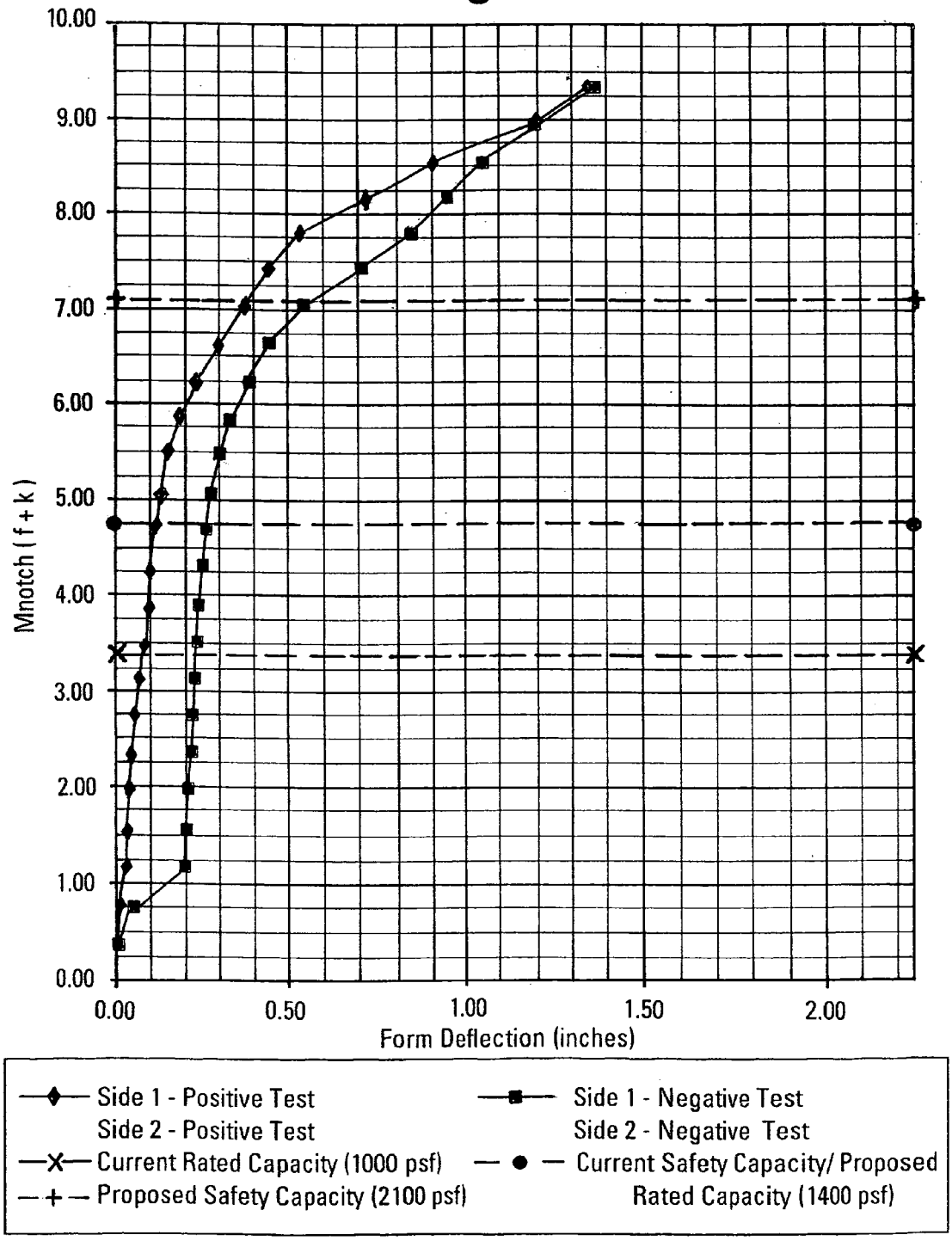
FIG. 7 is a chart of the deflection versus applied deflecting force of a form unmodified by the present invention.
Figure 8:
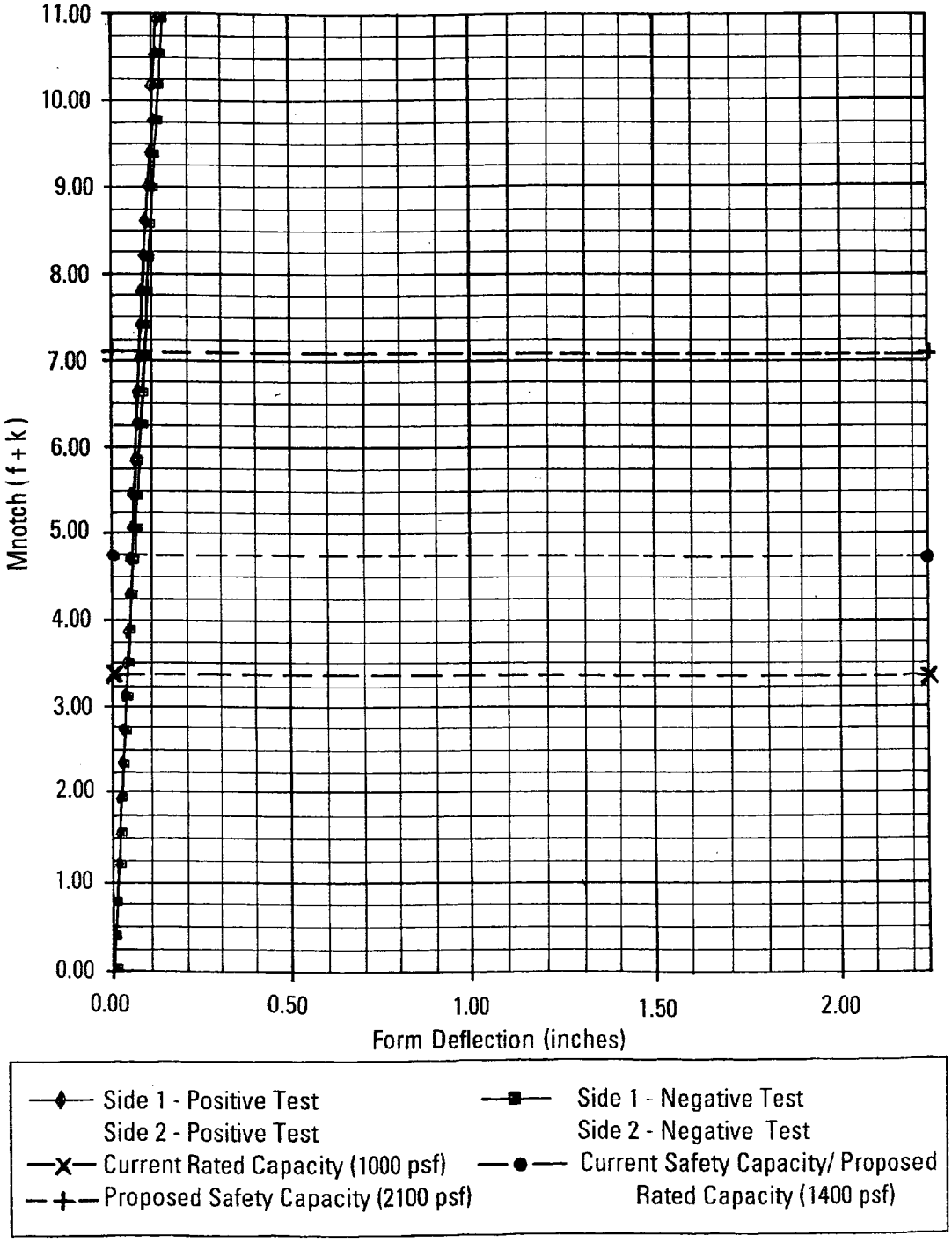
FIG. 8 is a chart of the deflection versus applied deflecting force of a form modified by the present invention.

Testing was performed on the form with and without the bridging straps. The form was supported rigidly at its ends and a hydraulic ram was used to apply a loading force centrally of the form at one of the strengthening ribs; the force was applied to the face sheet side of the form at a position near the perimetral flange and only the pretensioning bolts of that flange were tightened while the row of bolts on the opposite flange were left loose. Another set of measurements was taken with the force applied to the back of the form. The deflection of the form from its initial position was measured as a function of applied force. FIG. 7 illustrates the deflection measured with respect to a twelve-foot, six full flange segment form that did not have the supplemental bridging straps. The form of FIG. 7 is rated at of approximately 1000 pounds per square foot (psf) (the line on FIG. 7 at approximately 3.4) with a safety capacity of 1400 psf (the line at 4.75). The form starts to fail at around 1800–2200 psf (approximately 6–7 on FIG. 7). FIG. 8 illustrates the deflection measured with respect to a form that included six bridging straps, one for each flange segment of a twelve-foot form. The rated strength of the form has been raised to 1400 psf, or by 40%, and has a safety capacity of approximately 2100 psf. As can be seen in FIG. 8, the form did not start to fail within the limits of the test, that is, up to 11.0 or approximately 3300 psf. Addition of the supplemental bridging straps has dramatically increased the strength of the form, possibly as high as three-times the initial strength. Even at the rated capacity of 1400 psf, the head of plastic concrete that can be poured against a form including the straps is roughly double what could be poured against the same form without the straps.

Although the invention has been described with respect to a preferred embodiment thereof, it is to be understood that it is not to be so limited since changes and modifications can be made therein which are within the full intended scope of this invention as defined by the appended claims.

I claim:

1. A concrete form having a flexible panel member with an upstanding perimetral flange projected laterally from one side thereof and wherein said flange has a pair of transversely opposite side sections disposed on opposite ends of said form each of which side sections has a terminal surface portion extended inwardly in a direction parallel to said one side of the form, each of said opposite flange side sections is divided into a plurality of segments by a plurality of notches longitudinally spaced over the length thereof, with each notch terminating in a V-shape portion having the apex thereof adjacent said one side of the panel member whereby said panel member is laterally flexibly movable to a preselected generally curve shape, a plurality of bendable metal strap segments aligned end-to-end, and a plurality of central flange segments each having a terminal surface portion separated by a V-shaped notch, and each of said plurality of bendable metal strap segments interconnecting one of said plurality of central flange segments with a pair of flange segments adjacent on either side of each of said plurality of central flange segments, the improvement comprising a plurality of supplemental bridging straps each connected across a pair of adjacent bendable metal strap segments and to the corresponding flange segments.

2. The concrete form according to claim 1 wherein each of said plurality of bendable metal strap segments comprises a central portion fixed to one of said plurality of central flange segments, and a pair of opposing end portions releasably secured to said adjacent flange segments whereby said central flange segments are held in a fixed position relative to said adjacent flange segments.

3. The concrete form according to claim 1, wherein the end portions of a pair of adjacent bendable metal strap segments and a supplemental strap are interconnected to a flange segment by a pair of nut and bolt assemblies.

* * * * *